US008110744B2

(12) United States Patent
Wong et al.

(10) Patent No.: US 8,110,744 B2
(45) Date of Patent: Feb. 7, 2012

(54) FLEXIBLE SHIELDED CABLE

(75) Inventors: Suinin William Wong, Fremont, CA (US); Cheung-Wei Lam, San Jose, CA (US)

(73) Assignee: Apple Inc., Cupertino, CA (US)

( * ) Notice: Subject to any disclaimer, the term of this patent is extended or adjusted under 35 U.S.C. 154(b) by 185 days.

(21) Appl. No.: 12/193,850

(22) Filed: Aug. 19, 2008

(65) Prior Publication Data

US 2010/0044067 A1 Feb. 25, 2010

(51) Int. Cl.
*H01B 7/08* (2006.01)

(52) U.S. Cl. ..... 174/117 F

(58) Field of Classification Search ..... 174/117 F, 174/117 FF, 36, 250

See application file for complete search history.

(56) References Cited

U.S. PATENT DOCUMENTS

| | | | | |
|---|---|---|---|---|
| 3,060,790 | A | | 10/1962 | Ward |
| 3,754,209 | A | | 8/1973 | Molloy et al. |
| 4,814,552 | A | | 3/1989 | Stefik et al. |
| 4,845,311 | A | | 7/1989 | Schreiber et al. |
| 4,855,740 | A | | 8/1989 | Muramatsu et al. |
| 5,040,479 | A | | 8/1991 | Thrash |
| 5,081,482 | A | | 1/1992 | Miki et al. |
| 5,245,734 | A | | 9/1993 | Issartel |
| 5,317,105 | A | | 5/1994 | Weber |
| 5,342,991 | A | * | 8/1994 | Xu et al. ..... 174/117 R |
| 5,365,461 | A | | 11/1994 | Stein et al. |
| 5,371,901 | A | | 12/1994 | Reed et al. |
| 5,583,560 | A | | 12/1996 | Florin et al. |
| 5,726,645 | A | | 3/1998 | Kamon et al. |
| 5,770,898 | A | | 6/1998 | Hannigan et al. |
| 5,815,379 | A | | 9/1998 | Mundt |
| 5,831,601 | A | | 11/1998 | Vogeley et al. |
| 5,951,908 | A | | 9/1999 | Cui et al. |
| 5,975,953 | A | | 11/1999 | Peterson |
| 6,130,822 | A | | 10/2000 | Della Fiora et al. |
| 6,180,048 | B1 | | 1/2001 | Katori |
| 6,337,678 | B1 | | 1/2002 | Fish |
| 6,347,882 | B1 | | 2/2002 | Vrudny et al. |
| 6,525,929 | B2 | | 2/2003 | Carr |
| 6,532,446 | B1 | | 3/2003 | King |
| 6,611,253 | B1 | | 8/2003 | Cohen |
| 6,713,672 | B1 | | 3/2004 | Stickney |

(Continued)

FOREIGN PATENT DOCUMENTS

EP 1881513 1/2008

(Continued)

OTHER PUBLICATIONS

Author Unknown, "Electronic Polymers, Semiconducting Polymers and Light Emitting Polymers—Focus of Polythiophene," Azom.com, http://www.azom.com/details.asp?ArticleID=2772, at least as early as Dec. 1, 2005.

(Continued)

*Primary Examiner* — Chau N Nguyen
(74) *Attorney, Agent, or Firm* — Dorsey & Whitney LLP

(57) ABSTRACT

A flexible shielded cable is disclosed. The cable may include a plurality of conductors formed on a common base, a dielectric material disposed about the plurality of conductors, and a shielding material disposed adjacent the dielectric material. At least one of the plurality of conductors may include an unshielded portion not overlaid by the shielding material and at least one of the plurality of conductors may include a shielded portion overlaid by the shielding material.

19 Claims, 4 Drawing Sheets

U.S. PATENT DOCUMENTS

| | | | | |
|---|---|---|---|---|
| 6,717,073 | B2 | 4/2004 | Xu et al. | |
| 6,738,264 | B2 | 5/2004 | Takagi | |
| 6,794,992 | B1 | 9/2004 | Rogers | |
| 6,800,805 | B2 | 10/2004 | Deguchi | |
| 6,834,294 | B1 | 12/2004 | Katz | |
| 6,836,651 | B2 | 12/2004 | Segal et al. | |
| 6,914,551 | B2 | 7/2005 | Vidal | |
| 6,995,752 | B2 | 2/2006 | Lu | |
| 6,998,594 | B2 | 2/2006 | Gaines et al. | |
| 7,088,261 | B2 | 8/2006 | Sharp et al. | |
| 7,133,030 | B2 | 11/2006 | Bathiche | |
| 7,167,083 | B2 | 1/2007 | Giles | |
| 7,196,273 | B2 | 3/2007 | Tanaka et al. | |
| 7,274,303 | B2 | 9/2007 | Dresti et al. | |
| 7,315,908 | B2 | 1/2008 | Anderson | |
| 7,347,712 | B2 | 3/2008 | O'Connell et al. | |
| 7,417,624 | B2 | 8/2008 | Duff | |
| 7,446,303 | B2 | 11/2008 | Maniam et al. | |
| 7,453,441 | B1 | 11/2008 | Iorfida et al. | |
| 7,470,866 | B2 | 12/2008 | Dietrich et al. | |
| 7,473,139 | B2 | 1/2009 | Barringer et al. | |
| 7,489,308 | B2 | 2/2009 | Blake et al. | |
| 7,557,690 | B2 | 7/2009 | McMahon | |
| 7,598,686 | B2 | 10/2009 | Lys et al. | |
| 7,634,263 | B2 | 12/2009 | Louch et al. | |
| 7,646,379 | B1 | 1/2010 | Drennan et al. | |
| 7,710,397 | B2 | 5/2010 | Krah et al. | |
| 2003/0174072 | A1 | 9/2003 | Salomon | |
| 2003/0210221 | A1 | 11/2003 | Aleksic | |
| 2004/0230912 | A1 | 11/2004 | Clow et al. | |
| 2004/0238195 | A1 | 12/2004 | Thompson | |
| 2005/0110777 | A1 | 5/2005 | Geaghan et al. | |
| 2005/0162411 | A1 | 7/2005 | Berkel van | |
| 2005/0200286 | A1 | 9/2005 | Stoschek et al. | |
| 2005/0200557 | A1 | 9/2005 | Tanaka et al. | |
| 2006/0042820 | A1 | 3/2006 | Lin et al. | |
| 2006/0151198 | A1* | 7/2006 | Bracaleone | 174/117 FF |
| 2007/0050054 | A1 | 3/2007 | Guruparan et al. | |
| 2007/0124772 | A1 | 5/2007 | Bennett et al. | |
| 2007/0174058 | A1 | 7/2007 | Burns et al. | |
| 2007/0195068 | A1 | 8/2007 | Kable et al. | |
| 2007/0285405 | A1 | 12/2007 | Rehm | |
| 2008/0001787 | A1 | 1/2008 | Smith et al. | |
| 2008/0150917 | A1 | 6/2008 | Libbey et al. | |
| 2008/0291620 | A1 | 11/2008 | DiFonzo et al. | |
| 2009/0002328 | A1 | 1/2009 | Ullrich et al. | |
| 2009/0009489 | A1 | 1/2009 | Lee | |
| 2009/0035600 | A1* | 2/2009 | Chiang | 428/623 |
| 2009/0104898 | A1 | 4/2009 | Harris | |
| 2009/0167704 | A1 | 7/2009 | Terlizzi et al. | |
| 2009/0173533 | A1 | 7/2009 | Brock et al. | |
| 2009/0173534 | A1 | 7/2009 | Keiper et al. | |
| 2009/0176391 | A1 | 7/2009 | Brock et al. | |
| 2009/0222270 | A2 | 9/2009 | Likens et al. | |
| 2009/0277763 | A1 | 11/2009 | Kyowski et al. | |
| 2009/0283342 | A1 | 11/2009 | Schediwy et al. | |
| 2010/0053468 | A1 | 3/2010 | Harvill | |
| 2010/0081375 | A1 | 4/2010 | Rosenblatt et al. | |
| 2010/0214226 | A1 | 8/2010 | Brown et al. | |
| 2010/0300856 | A1 | 12/2010 | Pance et al. | |
| 2010/0301755 | A1 | 12/2010 | Pance et al. | |
| 2010/0302169 | A1 | 12/2010 | Pance et al. | |
| 2010/0306683 | A1 | 12/2010 | Pance et al. | |
| 2011/0037734 | A1 | 2/2011 | Pance et al. | |
| 2011/0038114 | A1 | 2/2011 | Pance et al. | |

FOREIGN PATENT DOCUMENTS

| | | |
|---|---|---|
| EP | 2017694 | 1/2009 |
| FR | 2801402 | 5/2001 |
| GB | 2433211 | 6/2007 |
| JP | 58112263 | 7/1983 |
| KR | 2002013984 | 2/2002 |
| KR | 20030035305 | 5/2003 |
| WO | WO01/69567 | 9/2001 |
| WO | WO02/073587 | 9/2002 |
| WO | WO2005/065034 | 7/2005 |
| WO | WO2009/059479 | 5/2009 |
| WO | WO2009/136929 | 11/2009 |
| WO | WO2010/058376 | 5/2010 |

OTHER PUBLICATIONS

Author Unknown, "Long Polymers Light Up LEDs," Physicsweb.org, http://www.physicsweb.org/articles/news/6/4/22/1, at least as early as Apr. 30, 2002.

Author Unknown, "Optimus Keyboard," Art.Lebedev Studio, http://www.artlebedev.com/portfolio/optimus/, at least as early as Dec. 1, 2005.

Author Unknown, "Optimus OLED Keyboard," Gizmodo: The Gadgets Weblog, http://www.gizmodo.com/gadgets/peripherals/input/optimus-oled-keyboard-112517.php, at least as early as Dec. 1, 2005.

Author Unknown, "Optimus OLED Keyboard with Customizable Layout," Gear Live, http://www.gearlive.com/index.php/news.article/optimus_oled_keyboard_07131058/, at least as early as Dec. 1, 2005.

Author Unknown, "Optimus Russian Keyboard," Primo Tech, http://www.primotechnology.com/index.php?art+articles/0705/optimus/index.htm, at least as early as Dec. 1, 2005.

Author Unknown, "Organic Light-Emitting Diode," Wikipedia.com, http://en.wikipedia.org/wiki/OLED, at least as early as Dec. 1, 2005.

Author Unknown, "Organic Polymers to Precede Nano Semi," EETimes.com, http://www.eet.com/story/OEG20030923S0055, at least as early as Dec. 1, 2005.

Author Unknown, "Physics News Update," American Institute of Physics, http://www.aip.org/pnu/1993/split/pnul148-3.htm, Oct. 19, 1993.

Author Unknown, "Polymer Light-Emitting Diodes," Philips Research—Technologies, http://www.research.philips.com/technologies/display/polyled/polyled/, at least as early as Dec. 1, 2005.

Author Unknown, "RedEye mini Plug-in Universal Remote Adapter for iPhone, iPod touch and iPad," Amazon.com, 4 pages, date unknown.

Author Unknown, "Re iPhone Universal Remote Control—Infrared Remote Control Accessory for iPhone and iPod touch," http://www.amazon.com/iPhone-Universal-Remote-Control-Accessory/dp/tech-data/B0038Za . . . , 2 pages, at least as early as Jul. 15, 2010.

Author Unknown, "What is OLED (Organic Light Emitting Diode)?," WiseGeek.com, http://www.wisegeek.com/what-is-an-oled.htm!referrer+adwords_campaign=oled_ad=024 . . . , at least as early as Dec. 1, 2005.

Author Unknown, "What is PLED?—A Word Definition from the Webopedia Computer Dictionary," http://www.webopedia.com/TERM/P/PLED/html, at least as early as Dec. 1, 2005.

Braun et al., "Transient Response of Passive Matrix Polymer LED Displays,"http://www.ee.calpoly.edu/~dbraun/papers/ICSM2000BraunEricksonK177.html, at least as early as Dec. 1, 2005.

IBM, "Additional Functionality Added to Cell Phone via "Learning" Function Button," www.ip.com, 2 pages, Feb. 21, 2007.

Kwon et al., "Haptic Interferences for Mobile Devices: a Survey of the State of the Art," Telerobotics and Control Laboratory, KAIST (Korea Advanced Institute of Science and Technology, Korea, Dec. 11, 2007.

Motorola TDB et al., "Universal Programmable Remote Control/Telephone," www.ip.com, 2 pages, May 1, 1992.

Rojas, "Optimus Keyboard Trumped by the Display Keyboard?," http://www.engadget.com/2005/07/29/optimus-keyboard-trumped-by-the-display-keyboard/, Jul. 29, 2005.

* cited by examiner

FLEXIBLE SHIELDED CABLE

TECHNICAL FIELD

The present invention relates generally to electrical conductors, and more particularly to a shielded cable with improved flexibility.

BACKGROUND

Electronic devices are ubiquitous in society and can be found in everything from computers to cellular telephones. These electronic devices often have many electrical signals that are communicated among various subsystems of the electrical device. The electrical signals are often conveyed through some type of physical media that include cable-type conductors capable of routing the electrical signals. Cable conductors often communicate a plurality of signals within a single cable by including multiple strands of electrical conductors within the single cable. For example, a cable may include multiple strands of copper conductors, one for each signal being conveyed.

One problem with conventional conductors is electromagnetic interference (EMI). EMI may be generated by any conductor carrying an electrical signal. In cables containing multiple strands of conductors, the EMI generated in one conductor may interfere with the signal being communicated in other adjacent conductors or electrical devices. Emitting EMI in this manner may cause the electronic device not to function as expected and/or may cause the electronic device to exceed EMI emission levels established by governmental regulations. EMI likewise poses at least two issues for a conductor in an electronic device. First, the conductor may emit EMI, thereby interfering with the operations of other components of the electronic device or other nearby devices. Second, EMI from an external source may corrupt a signal or data carried on the conductor.

To reduce EMI interference and/or emission, conductors are often insulated with shielding materials. Unfortunately, shielding the conductors in this manner may introduce additional problems. For example, shielding the conductors may change their electrical impedance and affect their ability to convey electrical signals. Also, shielding the conductors may result in the cabling becoming thick and/or rigid thereby making it difficult to properly route the cable between various sub-portions of the electrical device. Accordingly, there is a need for a shielded cable that provides protection against EMI while minimizing changing the electrical characteristics and/or the flexibility of the cable.

SUMMARY

One or more embodiments may include a flexible shielded cable and methods for manufacturing the same. In one embodiment, the cable may include a plurality of conductors formed on a common base, a dielectric material disposed about the plurality of conductors, and a shielding material disposed adjacent the dielectric material. At least one of the plurality of conductors may include an unshielded portion not overlaid by the shielding material and at least one of the plurality of conductors may include a shielded portion overlaid by the shielding material.

Another embodiment may include a method of making a flexible cable, the method comprising the operations of determining the signal content of a first conductor determining the signal content of a second conductor adjacent to the first conductor, and selectively shielding the first conductor based upon the signal content of at least one of the first and second conductors.

In one embodiment, a flexible cable may be implemented in an electronic system. The electronic system comprising a first operating component, a second operating component, the cable coupling at least the first operating component to the second operating component. The cable comprising a plurality of conductors formed on a common base, a dielectric material disposed about the plurality of conductors, and a shielding material disposed adjacent the dielectric material. At least one of the plurality of conductors includes an unshielded portion not overlaid by the shielding material and at least one of the plurality of conductors includes a shielded portion overlaid by the shielding material.

BRIEF DESCRIPTION OF THE DRAWINGS

The use of the same reference numerals in different drawings indicates similar or identical items.

DETAILED DESCRIPTION OF THE INVENTION

The following discussion describes various embodiments including a flexible shielded cable. Although one or more of these embodiments may be described in detail, the embodiments disclosed should not be interpreted or otherwise used as limiting the scope of the disclosure, including the claims. In addition, one skilled in the art will understand that the following description has broad application. For example, the use of the term "cable" is intended to have broad application and include all cable types and electrical connectors in general. Accordingly, the discussion of any embodiment is meant only to be exemplary and is not intended to intimate that the scope of the disclosure, including the claims, is limited to these embodiments.

Generally, certain embodiments described herein may take the form of a cable that interconnects two electrical systems, components or subsystems. For example, the cable may be used in a computer to connect an input/output port to a storage device, a motherboard to a power supply, and so forth. Likewise, the cable may be used in a mobile or portable telephone, a stereo receiver, television and so forth. Accordingly, any sample operating embodiments that may be described herein should be regarded as illustrative and not limiting.

One sample embodiment may be a cable having an electrically conductive signal path formed thereon or therein. The signal path may be formed by traces of an electrically conductive material deposited on, formed on, or otherwise placed on a nonconductive layer. Further, a nonconductive layer may be placed over these signal traces in whole or in part. That is, the nonconductive layer may not extend across an entire width or along an entire length of the cable depending on the electrical characteristics of the signal trace. Signal traces are referred to herein as "conductors."

Figure 1:
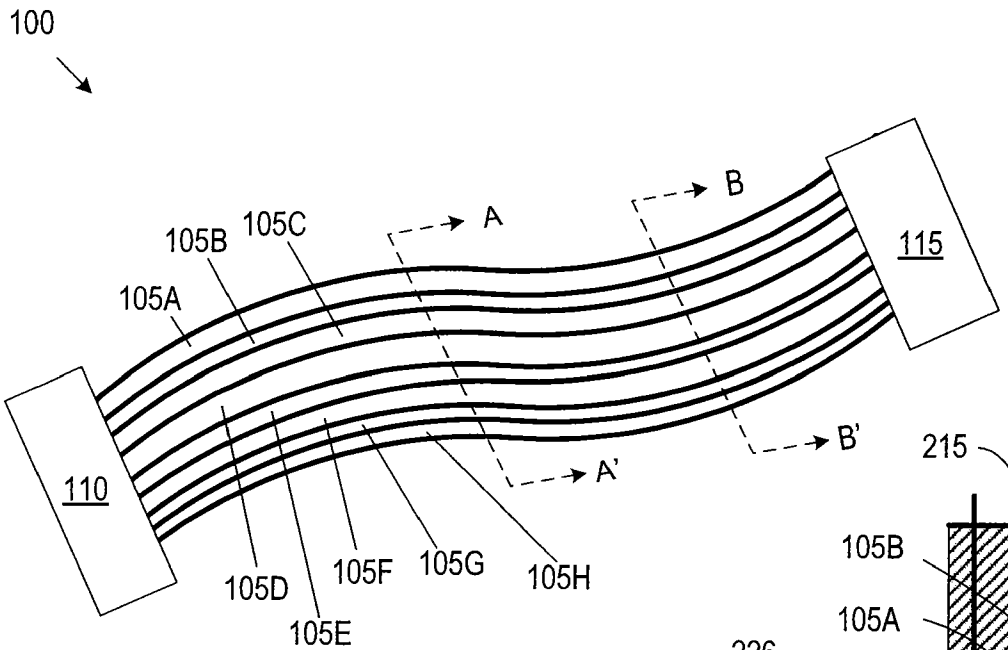
FIG. 1 illustrates an exemplary cable.

FIG. 1 illustrates an exemplary cable 100 that may include multiple conductors 105A-H. The cable 100 may couple together two electronic components 110 and 115. In some embodiments, this coupling may be electrical in nature and the conductors 105A-H may be made from electrically conductive materials such as copper, aluminum, and/or tin to name but a few.

During operation, the cable 100 generally establishes a signal path between two electrical components and thus may permit a first electrical component 110 to send and receive signals to and/or from a second electrical component 115 via the conductors 105A-H. Although FIG. 1 shows only two electronic components 110 and 115, it should be appreciated that any number of electronic components may be coupled together using a suitably configured cable 100. As will be described in more detail below, in some embodiments, the electronic components 110 and 115 may be sub-portions of a common electrical device and located within a common housing. In other embodiments, the electronic components 110 and 115 may be located in physically separate locations. The term "component," as used herein, is intended to refer both to subsystems of a larger electrical or electronic device (such as the hard drive, input/output connectors, motherboard, and processor of a computer) and stand-alone devices (such as the computer taken as a whole). By contrast, the term "device" generally refers to an overall apparatus or system into which a component may be integrated or which may include one or more components.

Depending upon the particular implementation, the electrical signals being conveyed over the conductors 105A-H may have different EMI parameters. For example, some conductors may convey electrical signals that change with respect to time, such as clock or data signals, while other conductors may include electrical signals that are relatively constant with respect to time, such as power supply signals. Signals that change with respect to time are more likely to emanate EMI (i.e., are more noisy) than those that are constant with respect to time. Also, some of the signals being conveyed over the conductors 105A-H may be more susceptible to EMI than others. For example, if the electronic components 110 and 115 are two routers within a data communication system, then the signals conveyed between the components 110 and 115 may high speed data signals that leave little room for signal error due to EMI. Because the electrical signals being conveyed over the conductors 105A-H may have different EMI parameters, in some embodiments, the content of the signal being conveyed via the conductors 105A-H may be used to determine selective shielding for the conductors 105A-H.

For example, if the conductor 105A includes a signal that emanates relatively high EMI levels it may be shielded. On the other hand, if the conductor 105H includes a signal with relatively low EMI levels it may be unshielded. Likewise, if the conductor 105A conveys a signal that is particularly susceptible to EMI it may be shielded, whereas if the signal in conductor 105H is relatively insensitive to EMI it may be unshielded. The actual EMI levels sufficient to consider a signal particularly susceptible to EMI or particularly insensitive to EMI may vary between embodiments and may be related to levels imposed by governmental regulation. Notably, shielded cables may be more rigid and less flexible than unshielded cables. Thus, by determining selective shielding patterns for the cable 100, a more flexible and less rigid cable 100 may be implemented and while providing desired levels of EMI protection. Accordingly, the environment in which the cable is placed, as well as its operating requirements, may also be a factor in determining how many or how few conductors are shielded. For example, a cable that is routed between components 110, 115 in such a manner that it must bend at relatively sharp angles in a relatively short distance may be less shielded than a straight-run cable.

In practice, the cable 100 may take a variety of physical forms. Some embodiments may implement the cable 100 as a flat ribbon-type cable where the conductors 105A-H are made of metallic conductive material such as copper, aluminum, and/or tin to name but a few. Other embodiments may implement the cable 100 using printed circuit board (PCB) technology such as microstrip and/or stripline technology.

Figure 2:
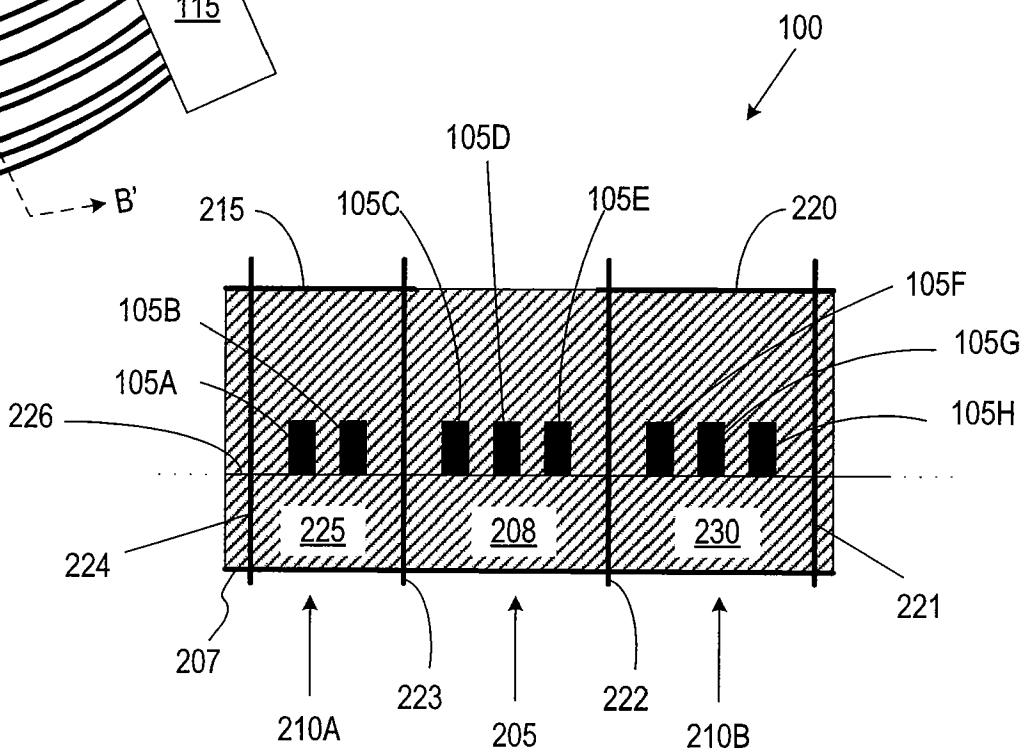
FIG. 2 illustrates an exemplary cross section of a cable.

FIG. 2 illustrates a cross section of the cable 100 (taken along the line A-A' of FIG. 1), showing the cable 100 formed of a combination of both stripline and microstrip technology. "Microstrip" refers to a type of transmission line that may be fabricated using PCB technology wherein the conductors may be separated from a ground plane using a substrate made of dielectric material. Section 205 illustrates an exemplary microstrip implementation where the conductors 105C-E may be separated from a ground plane 207 by a dielectric layer 208. By contrast, "stripline" refers to a type of transmission line that may be fabricated using PCB technology with the conductors sandwiched between two parallel ground planes using a substrate made of dielectric material. Sections 210A-B illustrate an exemplary stripline implementation where the conductors 105A-B and 105F-H may be separated from the ground planes 207, 215, and 220 by dielectric layers 225 and 230 respectively. In some embodiments, one or more the dielectric layers 208, 225, and/or 230 may include first and second portions. For example, dielectric 208 may include 208A and 208B (not specifically shown in FIG. 2) above and below a dielectric boundary line 226. In these embodiments, each dielectric may be deposited in layers above and beneath the conductors.

As shown, the first and second upper ground planes 215 and 220 may connect to the lower ground plane 207 through one or more vertically connecting vias 221-224. In this manner the vias 221-224, in combination with the upper and lower ground planes 207, 215, 220, may effectively define the cable 100 as incorporating different microstrip sections 205 and stripline sections 210A-B. It should be noted that the division between the microstrip and stripline sections shown is an example only. Alternative embodiments may include more or fewer of each type of section.

For both stripline and microstrip transmission lines, the width of the conductor, the thickness of the dielectric, and the relative permittivity of the dielectric may determine the characteristic impedance of the conductor. In some embodiments, such as the sections shown in sections 210A-B, the stripline conductors 105A-B and 105F-H may be equally spaced between the ground planes. However, in other embodiments, the striplines may be spaced asymmetrically with respect to the ground planes of the stripline sections in which or on which they are formed.

Depending upon the particular implementation, the dielectric used may vary to suit the particular implementation. For example, in some embodiments, dielectric layers 208, 225 and 230 may be built using FR4 type dielectric. However, in other embodiments, substances that have better high frequency performance, such as alumina, may be used to build the dielectric layers 208, 225 and 230.

Generally, the stripline sections 210A-B may provide better electrical isolation (e.g., isolation from EMI and/or prevention of EMI emission) for the conductors 105A-B and 105F-H than the microstrip section 205 may provide for that section's respective conductors 105C-E. By contrast, the microstrip section 205 may be less rigid and more flexible than the stripline sections 210A-B. Thus, in some embodiments, the cable 100 may be configured such that the microstrip sections are implemented over conductors that typically carry a signal which is relatively constant with respect to time and the stripline sections are implemented over conductors that carry a signal typically changing relatively frequently with respect to time. Exemplary signals that are relatively constant with respect to time may include power supply signals and/or real time clock signals (i.e., 32 kHz). Exemplary signals that change relatively frequently with respect to time may include high speed serial communication signals.

In other embodiments, signals that are more susceptible to EMI (or that emit EMI above a certain threshold) may be shielded by implementing stripline sections over conductors carrying these signals. For example, conductors 105A-B may convey differential signals, where the conductor 105A may convey the positive version of the differential signals and the conductor 105B may convey the negative version of the differential signal. Differential signals often are used to reduce the amount of noise induced in the signal by representing the signal of interest as the difference between the positive and negative versions of the differential signal, the notion being that EMI introduced in the conductor 105A will likewise be introduced in the conductor 105B so that the difference between them will cancel out this noise. By implementing stripline sections over the conductors carrying differential signals and microstrip sections over conductors carrying non-differential signals, the signal-to-noise ratio of the differential signals may be increased. As a result of increasing the signal-to-noise ratio of these differential signals, their power level may be decreased.

Figure 3:
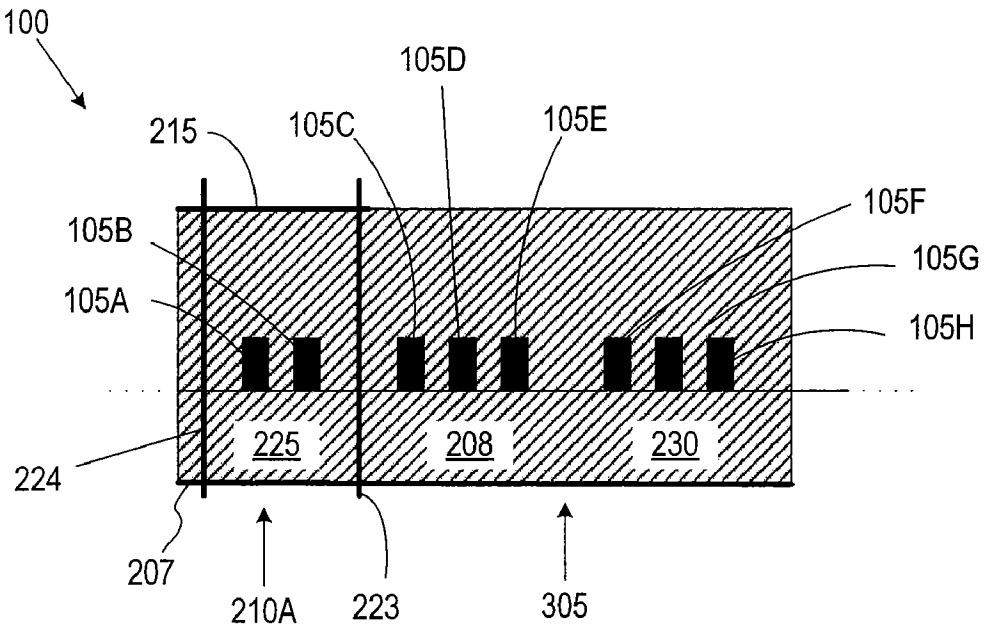
FIG. 3 illustrates another exemplary cross section of a cable.

FIG. 3 depicts another exemplary cross section of the cable 100 taken along line B-B' of FIG. 1. The cross section taken along B-B' may be located in a different portion of the cable 100 than the cross section taken along the line A-A'. As can be appreciated from comparing FIGS. 2 and 3, the upper ground plane 220 may be removed along with vias 221 and 222 to form a microstrip section 305 along at least this portion of the cable 100. In this manner, the cross sections shown in FIGS. 2 and 3 may be part of the same cable 100 despite having different stripline-microstrip configurations over the length of the cable 100. Thus, it may be appreciated that certain conductors may be shielded for a portion or the entirety of the cable's length. By configuring the shielding of the cable 100 such that certain conductors are shielded and others are not, the cable 100 may be fabricated so as to optimize the flexibility and the EMI shielding based upon the specific signals being conveyed on the various conductors.

Figure 4:
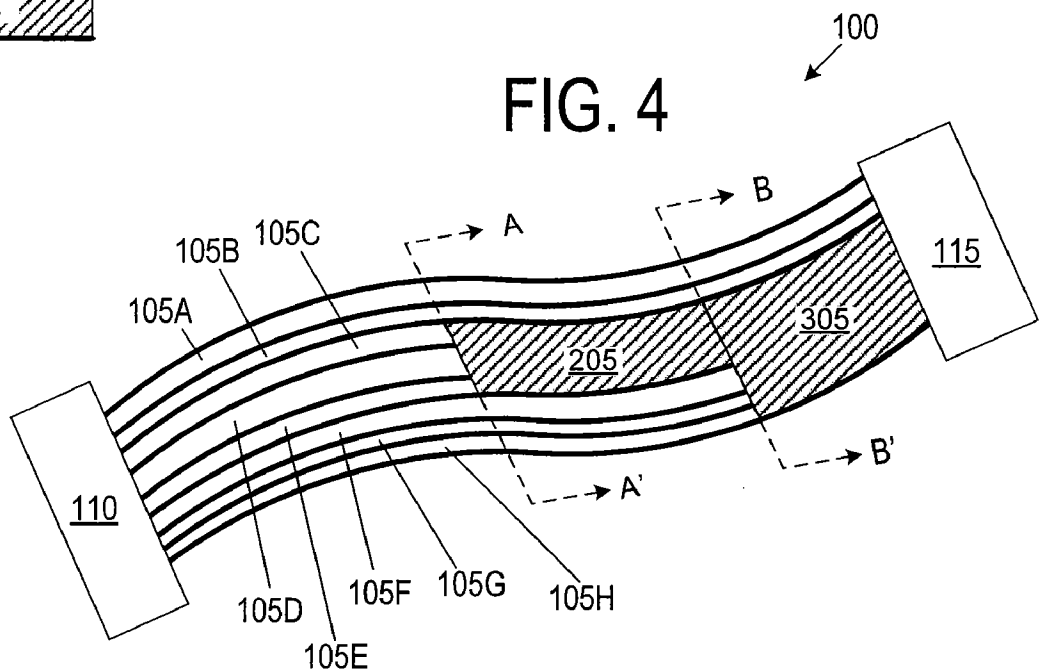
FIG. 4 illustrates an exemplary cable implementing the shielding configurations of FIGS. 2 and 3.

FIG. 4 illustrates a cable 100 implementing the exemplary shielding configurations shown in FIGS. 2 and 3. The microstrip portions 205 and 305 from FIGS. 2 and 3 are indicated using a hashed pattern to represent that the ground planes are not present over these portions of cable 100 in this embodiment.

Figure 5:
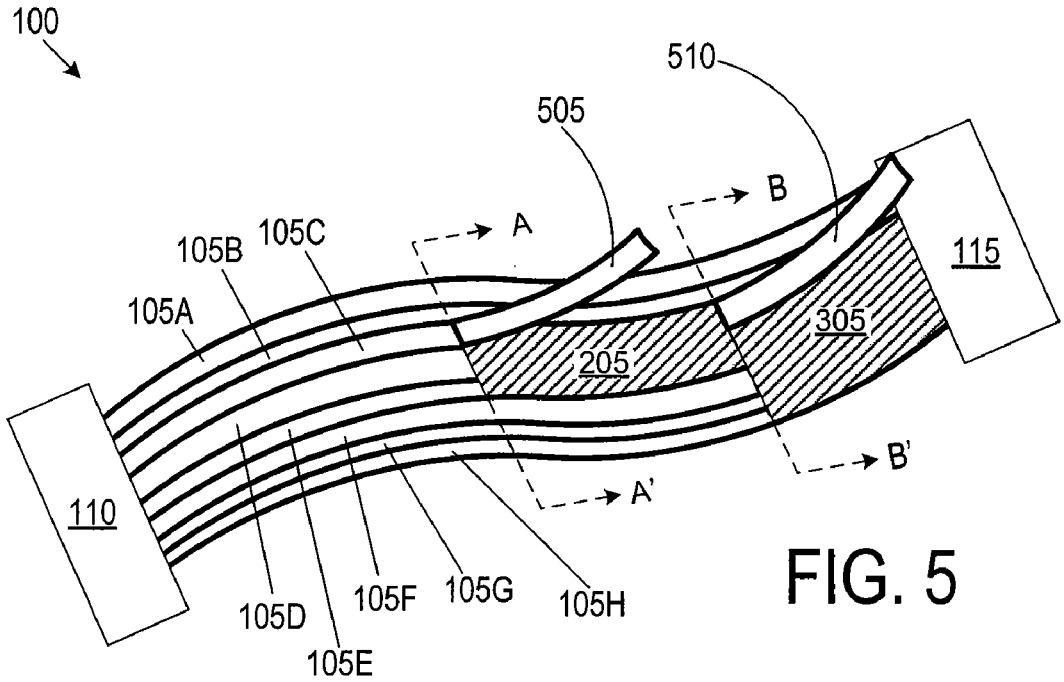
FIG. 5 illustrates exemplary removable portions of a cable.

In some embodiments, the particular shielding configurations may be determined after the cable 100 is coupled between the electrical components 110 and 115. This may provide more options for designers of the electronic components in that a single type of cable may be purchased and custom configured based on the particular needs of the electronic components and/or physical flexibility requirements of the cable. For example, in some embodiments, the shielding may be configured to be selectively removable based upon the content of the signals in the conductors. FIG. 5 illustrates exemplary removable shield portions 505 and 510 that may be selectively removed from the cable 100 and provide additional flexibility to the cable 100. Thus, based on the flexibility and EMI needs of the signals conveyed in the cable 100, one or more of these removable portions may be selectively removed. That is, certain segments of the shield portions (e.g., EMI shield or ground planes) may be peeled away or otherwise removed if unnecessary. The shield portions may be perforated or otherwise weakened at certain areas, lines and/or segments to facilitate their selective removal.

Figure 6:
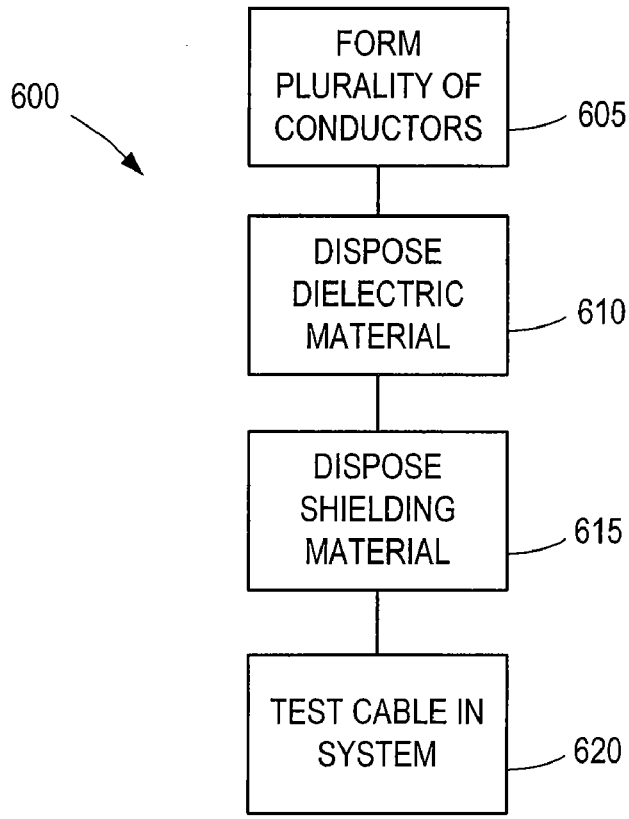
FIG. 6 illustrates an exemplary process for shielding the conductors.

FIG. 6 illustrates an exemplary process 600 for forming a cable including one or more selectively shielded conductors. In operation 605, the plurality of conductors may be formed. For example, one or more metal conductors may be deposited on a common substrate material, such as by using metal deposition techniques. A dielectric material may be disposed about the conductors per operation 610. Akin to operation 605, the dielectric material deposition in operation 610 may be disposed using deposition techniques. In some embodiments, the conductors and dielectric of operations 605 and 610 may formed using a series of deposition and etching techniques. The shielding layers and/or ground planes may be selectively disposed about the conductors such that some portions of the conductors have shielding while other portions of the conductors do not. This selective disposing of the shielding may be based upon a variety of cable specific factors such as, the signals being carried in the various conductors of the cable, the spacing of the conductors, and/or physical routing considerations of the cable in the electrical system to name but a few. In some embodiments, when designing the cable, the cable may be tested in an electrical system (such as the computer system described below with regard to FIG. 7) per operation 620. In this manner, if the cable does not meet desired flexibility requirements, then shielding may be removed as shown in FIG. 5.

Figure 7:
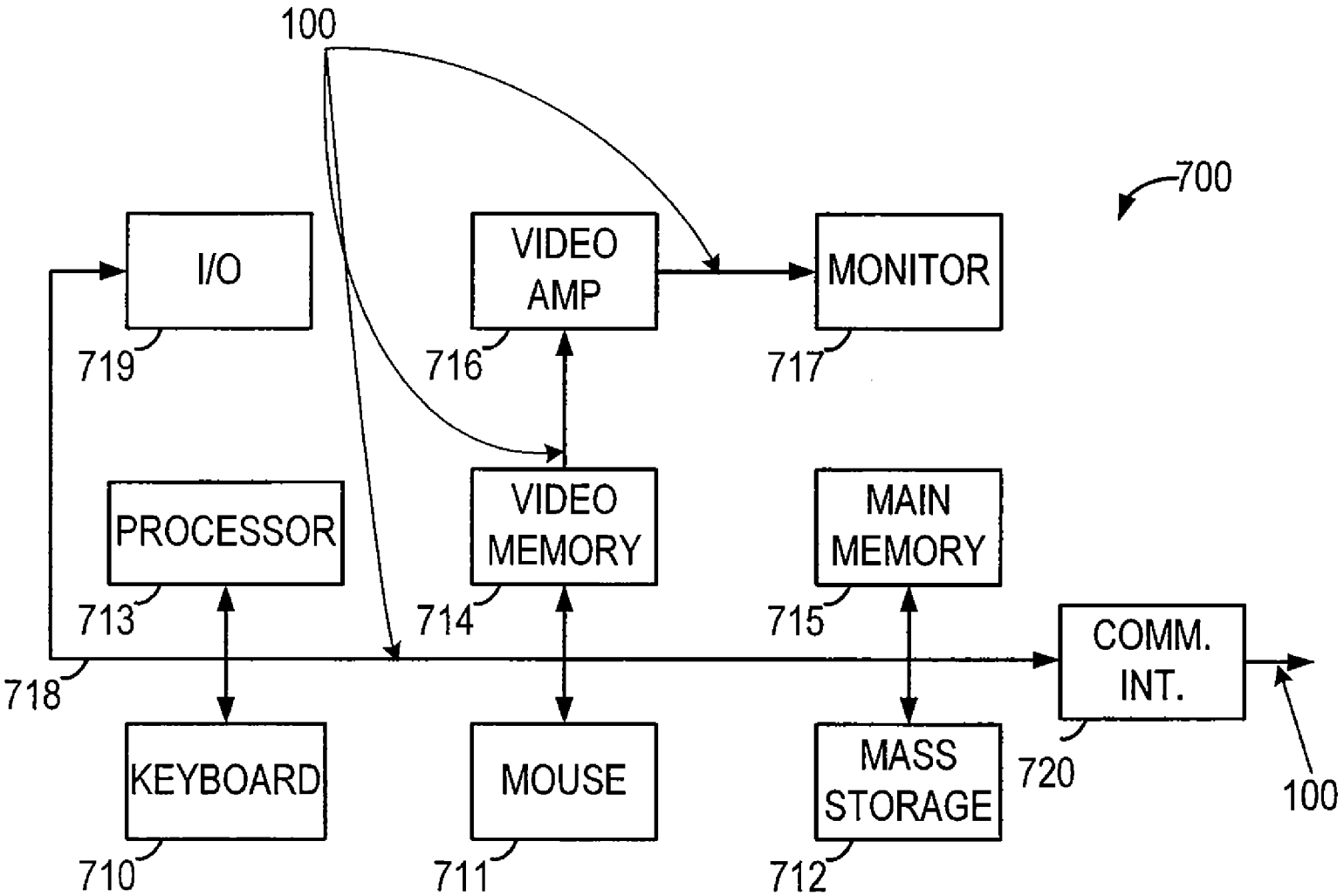
FIG. 7 illustrates an exemplary electronic system.

The cable 100 may be implemented in a variety of different electronic devices. FIG. 7 shows an exemplary computer system 700, where the cable 100 may be used to couple together two or more of the computer system's subcomponents. The cable 100 also may be used to couple the computer system 700 to other computer systems. For example, in some embodiments, the computer system 700 may be an implementation of an enterprise level computer such as a blade-type server, and the cable 100 may be used to couple it to one or more additional blade-type servers within an enterprise. In other embodiments, the computer system 700 may be a personal computer and/or a handheld electronic device and the cable 100 may couple together various sub-components of the electronic device.

A keyboard 710 and mouse 711 may be coupled to the computer system 700 via a system bus 718. The keyboard 710 and mouse 711, in one example, may introduce user input to computer system 700 and communicate that user input to a processor 713. Other suitable input devices may be used in addition to, or in place of, mouse 711 and keyboard 710. An input/output unit 719 (I/O) coupled to system bus 718 represents such I/O elements as a printer, audio/video (A/V) I/O, etc.

Computer 700 also may include a video memory 714, a main memory 715 and a mass storage 712, all coupled to system bus 718 along with keyboard 710, mouse 711 and processor 713. Mass storage 712 may include both fixed and removable media, such as magnetic, optical or magnetic optical storage systems and any other available mass storage technology. Bus 718 may contain, for example, address lines for addressing video memory 714 or main memory 715. System bus 718 also includes, for example, a data bus for transferring data between and among the components, such as processor 713, main memory 715, video memory 714 and mass storage 712. Video memory 714 may be a dual-ported video random access memory. One port of video memory 714, in one example, is coupled to video amplifier 716, which is used to drive a monitor 717. Monitor 717 may be any type of monitor suitable for displaying graphic images, such as a cathode ray tube monitor (CRT), flat panel, or liquid crystal display (LCD) monitor or any other suitable data presentation device.

In some embodiments, processor 713 is a SPARC® microprocessor from Sun Microsystems, Inc., or a microprocessor manufactured by Motorola, such as the 680XX0 processor, or a microprocessor manufactured by INTEL, such as the 80X86, PENTIUM or other suitable processor. Any other suitable microprocessor or microcomputer may be utilized, however.

Computer 700 also may include a communication interface 720 coupled to bus 718. Communication interface 720 provides a two-way data communication coupling via a network link. For example, communication interface 720 may be an integrated services digital network (ISDN) card or a modem, a local area network (LAN) card, or a cable modem or wireless interface. In any such implementation, communication interface 720 sends and receives electrical, electromagnetic or optical signals which carry digital data streams representing various types of information.

Code received by computer 700 may be executed by processor 713 as it is received, and/or stored in mass storage 712, or other non-volatile storage for later execution. In this manner, computer 700 may obtain application code in a variety of forms. Application code may be embodied in any form of computer program product such as a medium configured to store or transport computer readable code or data, or in which computer readable code or data may be embedded. Examples of computer program products include CD-ROM discs, ROM cards, floppy disks, magnetic tapes, computer hard drives, servers on a network, and solid state memory devices.

Although the present invention has been described with reference to preferred embodiments, persons skilled in the art will recognize that changes may be made in form and detail without departing from the spirit and scope of the invention. For example, in some embodiments, the cable 100 may couple electronic devices together optically, and the conductors 105A-H may be made from an optically conductive material, such as glass, plastic, and/or quartz to name but a few.

What is claimed is:

1. A flexible cable, comprising:

a plurality of conductors formed on a common base;

a dielectric material disposed about the plurality of conductors; and a shielding material disposed adjacent the dielectric material; wherein at least one of the plurality of conductors includes an unshielded portion, implemented using microstrip technology, not overlaid by the shielding material and further including a first section with a first flexibility and a second section with a second flexibility, wherein the first flexibility is greater than the second flexibility, and the locations of the first and second sections correspond to the physical routing of the flexible cable; and at least one of the plurality of conductors includes a shielded portion, implemented using stripline technology, overlaid by the shielding material.

2. The flexible cable of claim 1, wherein the at least one conductor with the unshielded portion is part of a group of unshielded conductors each of which includes at least one portion that is unshielded.

3. The flexible cable of claim 2, wherein the number of conductors within the group of unshielded conductors and the number of conductors within a group of shielded conductors determines a flexibility ratio of the flexible cable.

4. The flexible cable of claim 3, wherein the group of unshielded conductors are implemented using microstrip technology and the group of shielded conductors are implemented using stripline technology.

5. The flexible cable of claim 1, wherein the shielding material is selectively disposed about the dielectric material.

6. The flexible cable of claim 1, wherein the at least one conductor with the unshielded portion conveys a signal substantially constant with respect to time.

7. The flexible cable of claim 1, wherein the at least one conductor with the unshielded portion conveys a signal that contains more than a predetermined level of noise and the location of the unshielded portion corresponds to the physical routing of the flexible cable.

8. The flexible cable of claim 1, wherein the shielding material is segmented such that it is selectively removable and the unshielded portion is formed after the flexible cable is manufactured.

9. The flexible cable of claim 1, wherein the shielding material is selectively disposed along the length of the at least one conductor with the unshielded portion such that a first section along the length of the at least one conductor is substantially void of shielding material and a second section along the length of the at least one conductor includes a greater amount of shielding material than the first section.

10. A method of manufacturing a flexible cable, the method comprising the operations of:

forming a plurality of conductors on a common base;

disposing a dielectric material about the plurality of conductors;

disposing a shielding material adjacent the dielectric material; whereby at least one of the plurality of conductors includes an unshielded portion, implemented using microstrip technology, not overlaid by the shielding material and further including a first section with a first flexibility and a second section with a second flexibility, wherein the first flexibility is greater than the second flexibility, and the locations of the first and second sections correspond to the physical routing of the flexible cable; and at least one of the plurality of conductors includes a shielded portion, implemented using stripline technology, overlaid by the shielding material.

11. The method of claim 10, whereby the at least one conductor with the unshielded portion is part of a group of unshielded conductors each of which includes at least one portion that is unshielded.

12. The method of claim 11, whereby the at least one conductor with the shielded portion is part of a group of shielded conductors each of which includes at least one portion that is shielded.

13. The method of claim 10, whereby the operation of disposing the shielding material comprises the operation of selectively disposing the shielding material about the dielectric material.

14. The method of claim 10, whereby the at least one conductor with the unshielded portion conveys a signal substantially constant with respect to time.

15. The method of claim 10, further comprising the operation of locating the unshielded portion to accommodate a location on the at least one conductor where routing flexibility is desired.

16. A computer system comprising:

a first operating component;

a second operating component;

a cable coupling at least the first operating component to the second operating component, the cable comprising:

a plurality of conductors formed on a common base;

a dielectric material disposed about the plurality of conductors; and a shielding material disposed adjacent the dielectric material; wherein at least one of the plurality of conductors includes an unshielded portion, implemented using microstrip technology, not overlaid by the shielding material and further including a first section with a first flexibility and a second section with a second flexibility, wherein the first flexibility is greater than the second flexibility, and the locations of the first and second sections correspond to the physical routing of the flexible cable; and at least one of the plurality of conductors includes a shielded portion, implemented using stripline technology, overlaid by the shielding material.

17. The computer system of claim 16, wherein the at least one conductor including the unshielded portion and the at least one conductor including the shielded portion are the same conductor and the unshielded and shielded portions are interleaved along the length of the at least one of the plurality of conductor.

18. The computer system of claim 17, wherein the interleaving corresponds to a predetermined level of noise within the at least one of the plurality of conductors.

19. The computer system of claim 16, wherein the unshielded portion is created based upon one or more signals communicated between the first and second operating components.

* * * * *